US006758558B2

(12) United States Patent
Chiu et al.

(10) Patent No.: US 6,758,558 B2
(45) Date of Patent: Jul. 6, 2004

(54) INK CONTAINER HAVING A PRESSURE STABILIZER MODULE

(75) Inventors: Chuang-Hsien Chiu, Hsinchu (TW); Chien-Ming Lin, Taipei (TW); Kun-Lang Yang, Tainan (TW)

(73) Assignee: NanoDynamics Inc., Hsinchu (TW)

( * ) Notice: Subject to any disclaimer, the term of this patent is extended or adjusted under 35 U.S.C. 154(b) by 0 days.

(21) Appl. No.: 10/355,297

(22) Filed: Jan. 31, 2003

(65) Prior Publication Data

US 2003/0146960 A1 Aug. 7, 2003

(30) Foreign Application Priority Data

Feb. 7, 2002 (TW) ..... 91102139 A
Dec. 6, 2002 (TW) ..... 91135475 A

(51) Int. Cl.[7] ..... B41J 2/175
(52) U.S. Cl. ..... 347/86
(58) Field of Search ..... 347/85, 86, 87

(56) References Cited

U.S. PATENT DOCUMENTS 5,040,002 A 8/1991 Pollacek et al.
5,754,207 A * 5/1998 Gragg et al. ..... 347/86
5,767,882 A * 6/1998 Kaplinsky et al. ..... 347/87
6,273,563 B1 * 8/2001 Volker ..... 347/86
6,494,568 B2 * 12/2002 Hou et al. ..... 347/86

FOREIGN PATENT DOCUMENTS

JP 06-183023 A * 7/1994 ..... B41J/2/175

* cited by examiner

*Primary Examiner*—Anh T. N. Vo
(74) *Attorney, Agent, or Firm*—Birch, Stewart, Kolasch & Birch, LLP

(57) ABSTRACT

The specification discloses an ink container having a pressure stabilizer module. The module contains an airtight membrane, a passive plate, and an elastic device. The airtight membrane separates a box into an ink chamber and an air chamber. The passive plate is connected to one side of the airtight membrane and to the elastic device. The elastic device is normally depressed or stretched to move the airtight membrane. The ink chamber is thus slightly extended outward and maintains a negative pressure. As the ink stored inside the ink chamber gets less, the elastic device provides a restoring force to push or drag the passive plate. The negative pressure is thus maintained within a specific range. The invention further uses a conic spiral spring to avoid ink waste.

10 Claims, 10 Drawing Sheets

INK CONTAINER HAVING A PRESSURE STABILIZER MODULE

BACKGROUND OF THE INVENTION

1. Field of Invention

The invention relates to an ink container for inkjet printers and, in particular, to an ink container that maintains the negative pressure.

2. Related Art

The inkjet printer used in homes or offices has two parts: the ink cartridge and the inkjet print head. The inkjet print heads can be further classified into two categories: the thermal bubble system and the piezoelectric system.

Although the above-mentioned two systems are good and highly efficient inkjet print head designs, a mechanism is required to prevent ink from permeating out of the nozzles. If ink permeates out of the nozzle, it may cause ink droplets to fall imprecisely, deteriorating the printing quality. To solve this problem, a slight negative pressure has to be maintained inside the ink cartridge, so that no ink will leak out from the nozzles if the inkjet print head is paused or stops working. The negative pressure means that the pressure inside the ink chamber is smaller than that of the ambient air. However, if the negative pressure is too large, it will cancel with the pushing force of the print head to eject ink. A possible consequence is: the sizes of the ink droplets are hard to control or getting smaller. This also deteriorates the printing quality. Ink droplets may even be impossible to be ejected out as the condition gets to the worst.

To maintain normal operation conditions, the negative pressure has to be kept within a desired operating range. In other words, the negative pressure has to be greater than a value to prevent ink from permeating out of the inkjet print head, but also simultaneously smaller than the value that interferes normal printing. To satisfy the above requirement, there are many different proposals for different products.

For example, James E. Pollacek et al. proposed "regulator for inkjet pens" in the U.S. Pat. No. 5,040,002. According to them, a ventilation hole is opened directly on the ink cartridge. A metal valve base is installed thereon too. A magnetic force is used to keep the valve closed until the negative pressure inside the cartridge is large enough for the atmospheric pressure to push open the valve, letting the ambient air to come in. Once the negative pressure get smaller, the valve is closed airtight again, keeping the negative pressure inside the cartridge. The above mechanism can sensitively maintain the negative pressure in the ink cartridge within the desired operating range.

Although the ink cartridge structure using a magnetic valve to control the air supply channel is nice, such products are susceptible to strong magnetic fields. If they experience a strong magnetic field during transportation or use, the magnetic properties of the metal valve base and the valve will be changed. As a result, the operating range of the negative pressure cannot be correctly controlled.

SUMMARY OF THE INVENTION

In view of the foregoing, the invention provides an ink container, which has a pressure stabilizer module with a simple structure for ink stored inside the ink chamber to be fully utilized and not affected by the magnetic force.

The ink container having a pressure stabilizer module according to the invention contains a box and more than one stabilizer module. The stabilizer module is installed inside the box and protected by the strong shell of the box. The stabilizer module contains an airtight membrane that can be elastically deformed. It separates the box into an ink chamber and an air chamber. The ink chamber stores ink for printing. A passive plate in an arc or plane shape is connected to one side of the airtight membrane inside the ink chamber. An elastic device is connected to the passive plate and installed on the inner side of the ink chamber, so that it is normally suppressed. In particular, a conic spiral spring is utilized. The height of the spring under pressure is closed to the thickness of the spring wire. Therefore, as the ink gets less during use, the space of the ink chamber also shrinks. The elastic device is depressed to provide an elastic force to push the passive plate, putting a limit on the shrinking extent of the ink chamber. Under the influence of the elastic device, the ink chamber obtains a negative pressure that is maintained within a specific range. Since the height of the conic spiral spring is merely the thickness of the spring wire, it can prevent ink inside the ink chamber from remaining therein. On the other hand, one end of the box is opened with a through hole to connect to the ambient space. Ambient air can enter the air chamber via the through hole to balance the pressure inside the box. As the ambient temperature or pressure changes, it can make the corresponding adjustment. The bottom of the ink chamber is installed with an ink channel connected to a nozzle on another end of the box. Therefore, the ink stored inside the ink chamber can be ejected out for printing.

It should be noted that the separation between the ink chamber and the air chamber by the airtight membrane keep the ink chamber airtight. The design of the air chamber does not necessarily require a through hole, as long as some space is saved for the ambient air to enter the air chamber.

Another preferred embodiment of the invention is different from the previous one in that: the passive plate is connected to the outer side of the ink chamber, i.e. the air chamber on the other side of the airtight membrane. In the case, the elastic device is installed in the air chamber so that it is normally stretched. Likewise, when the ink gets less during use, the space of the ink chamber also shrinks. The elastic device provides a restoring elastic force to drag the passive plate, restricting the shrinking extent of the ink chamber. Therefore, the ink chamber obtains a negative pressure within a desired operating range. The nozzle can thus operate normally to eject ink.

The disclosed ink container having a pressure stabilizer module utilizes the connection between the conic spiral spring and the airtight membrane to maintain the negative pressure in the ink chamber within a specific range. Most important of all, the use of the conic spiral spring fully utilizes the stored ink, avoiding ink residues and unnecessary waste. According to the disclosed embodiments, the invention can be easily assembled. Each component can be readily obtained too. Therefore, the manufacturing cost is greatly reduced. Moreover, it is not affected by the external magnetic field. The printing quality is thus warranted.

BRIEF DESCRIPTION OF THE DRAWINGS

The invention will become more fully understood from the detailed description given hereinbelow illustration only, and thus are not limitative of the present invention, and wherein.

DETAILED DESCRIPTION OF THE INVENTION

The disclosed ink container has a pressure stabilizer module. It is used in inkjet printers. Through the interactions between a passive plate and an elastic device, the negative pressure inside the ink chamber can be stably maintained within a particular range that is ideal for ink to be ejected.

Figure 1:
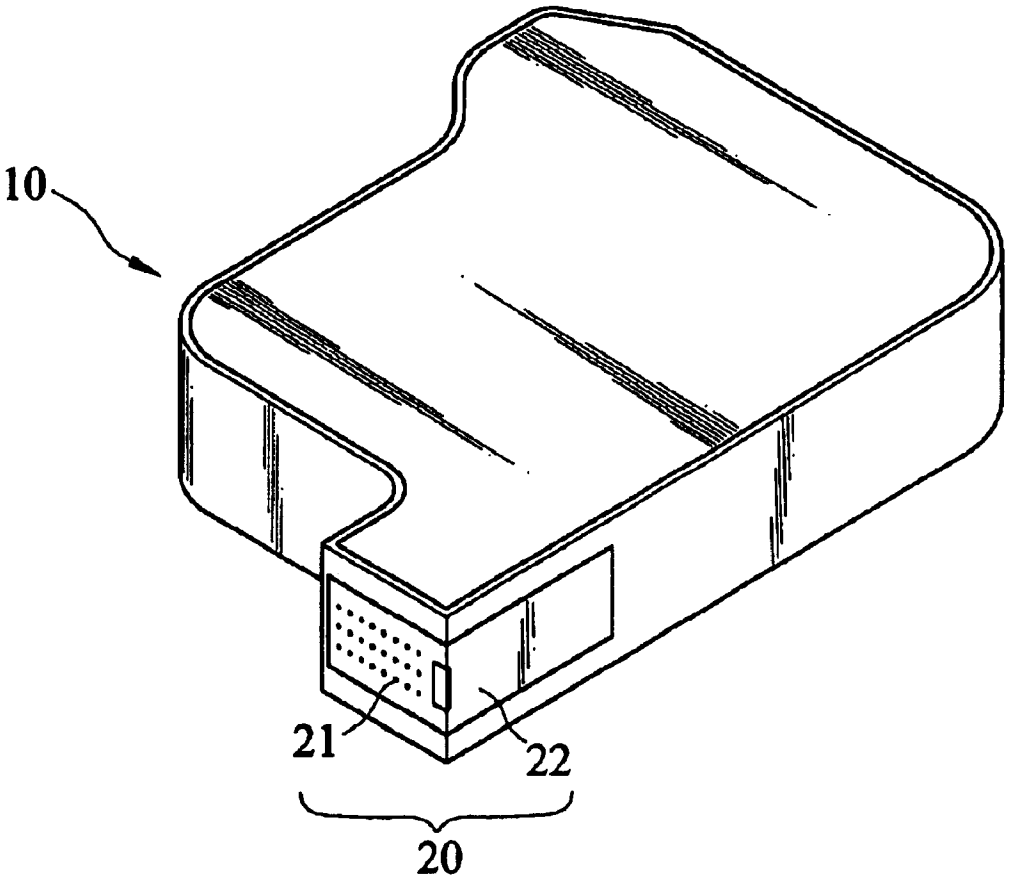
FIG. 1 is a three-dimensional view of the ink container having a pressure stabilizer module according to the invention.

With reference to FIG. 1 (note that the plot is only schematic and not to scale), the basic structure of an ink cartridge has a box 10 and a nozzle device 20. The nozzle device 20 has several tiny holes 21 and receives control signals via a flexible printed circuit 22. In accord with a series of input signals, ink droplets eject out of different tiny holes 21. It should be mentioned that the nozzle device 20 uses either the thermal bubble system or the piezoelectric system.

Figure 2A:
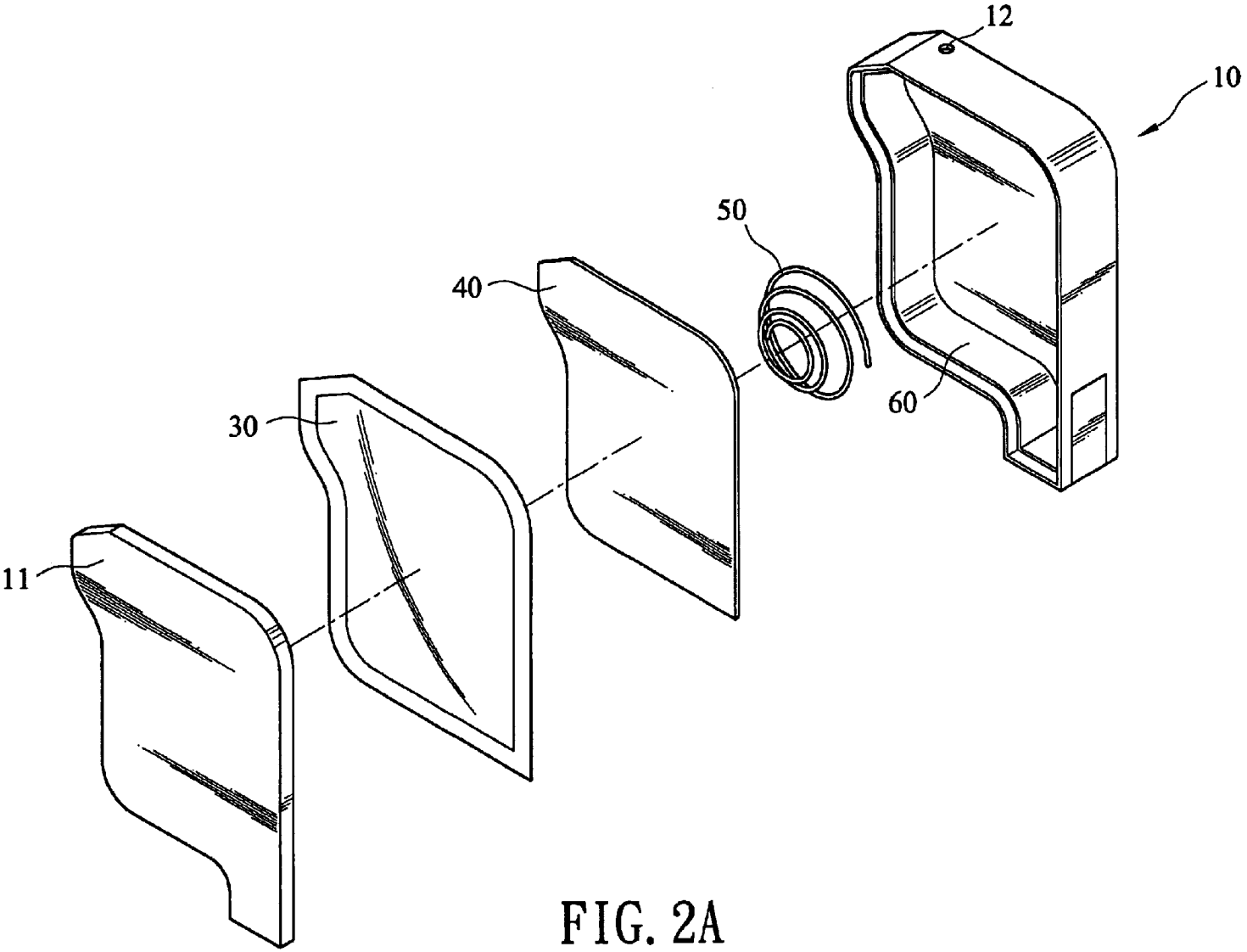
FIG. 2A is a schematic exploded view of the first embodiment of the invention.
Figure 3:
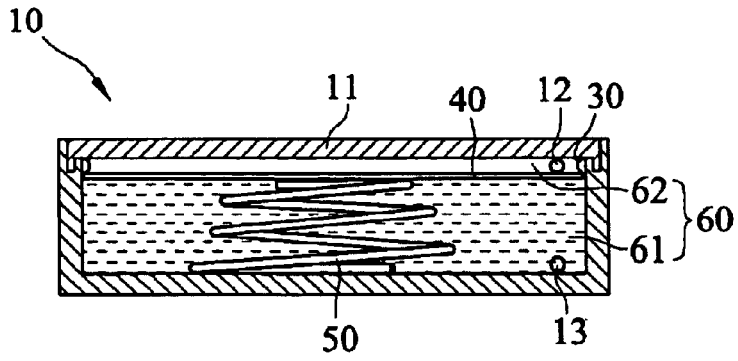
FIG. 3 is a schematic view of the actions in the first embodiment.

An embodiment of the invention is shown in FIG. 2A. The box 10 is a solid box with an accommodation 60 inside A cover plate covers and protects the devices contained therein. One side of the box has a through hole 12 to communicate with the exterior, so that ambient air can flow into the box 10 through the hole 12. It should be noted that one may leave a small gap when combining the cover plate 11 to the box 10 for the ambient air to flow in. In other words, the through hole 12 is not crucial as long as there is some other way to supply air. The pressure stabilizer module is installed inside the accommodation space. It includes: an air-tight membrane, which is made of elastic material that is deformable and attached tightly to the box 10 to separate the accommodation space 60 into two parts; an ink chamber 61; and an air chamber 62 (FIG. 3). The passive plate 40 is a flat plate or an arc-shape plastic material and is attached onto the airtight membrane 30. The elastic device 50 is usually a conic spiral spring. This kind of springs has a property that it can be depressed down to a length basically the same as the thickness of the spring wire. This is different from the usual spring, whose height is determined by multiplying the thickness of the spring wire by the number of coils. The invention uses this special property of the conic spiral springs to avoid ink from remaining in the ink chamber.

Figure 2B:
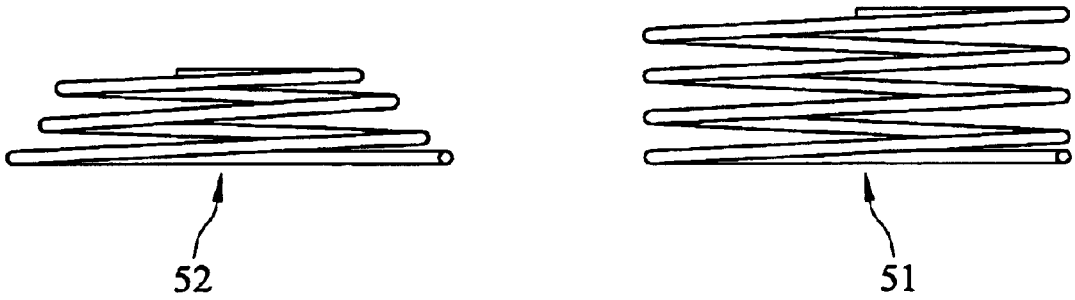
FIG. 2B is a schematic view of the elastic device in FIG. 2A.
Figure 2C:
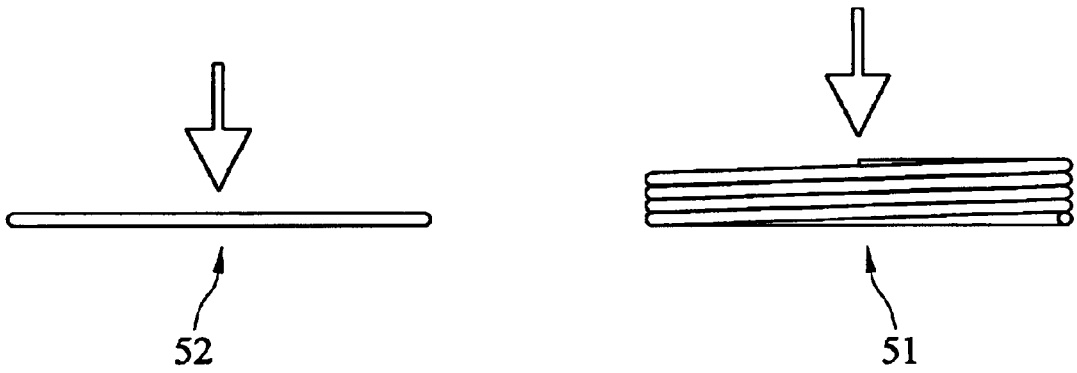
FIG. 2C is a schematic view of the elastic device in FIG. 2B being depressed.

Please refer to FIGS. 2B and 2C to see the advantages of the conic spiral spring used in the invention in comparison with the prior art. As shown in FIG. 2B, the conventionally used spring is a cylindrical spring, which is formed by coiling a long metal wire in a spiral way into a cylindrical shape. Although the conic spiral spring 52 used herein is also made of a long metal wire, it is however bent into a conic shape. When these two types of springs deform under pressure, the conventional cylindrical spring 51 can be at most depressed down to the thickness of the spring wire times the number of coils, as shown in FIG. 2C. The conic spiral spring, on the other hand, can be depressed down to the thickness of the spring wire as a result of its geometric shape. For example, suppose the metal wire has a thickness of 1 mm and the number of coils is 12. The cylindrical spring under pressure has a height of at least 12 mm. However, the height of the conic spiral spring under pressure can be as small as 1 mm. Therefore, when the spring is installed inside the ink chamber, a large amount of ink will remain in the ink chamber for a conventional cylindrical spring (12 mm times the area of the ink chamber). If the conic spiral spring is used, only a small amount of ink will be left inside the ink chamber (1 mm times the area of the ink chamber). Consequently, the uses of a conic spiral spring 52 can effectively reduce ink waste. It should be noted that the spring force from the conic spiral spring 52 is determined by the spring wire thickness and the number of coils. Thus, one can select a conic spiral spring 52 with an appropriate wire thickness and number of coils.

We use FIG. 3 to further illustrate the operating principle and relations of all devices inside the box 10. We clearly see in the drawing the positions of all devices inside the solid box 10. First, the airtight membrane 30 separates the accommodation space 60 in the solid box 10 into two different regions, one being the ink chamber 61 and the other the air chamber 62. The ink chamber 61 stores ink needed for printing and is connected to the nozzle device through an ink channel 13. The air chamber 62 is in fluid communications with the ambient air via a through hole 12 opened on one side of the solid box 10 or the gap between the cover plate 11 and the solid box 10. When the volume of the ink chamber 61 shrinks due to uses, the air chamber 62 is replenished with air from ambient space. The pressure inside the solid box 10 is thus balanced. This also prevents the solid box 10 from deformation due to a large pressure difference. The passive plate 40 is attached to one side of the airtight membrane 30 and installed inside the ink chamber 61. There are many choices for the elastic device 50. Its main function is to provide a depressing force on the passive plate 40. The current embodiment uses the conic spiral spring mentioned above, one end of which is connected to the passive plate and the other end is touch with the box 10. The elastic device 50 touches against the ink chamber 61, so that there is a slightly larger room. If the ink chamber 61 does not have the elastic device 50, its pressure will be balanced with the atmospheric pressure. Therefore, ink will permeate out. The use of the elastic device 50 can make the pressure inside the ink chamber slightly smaller than the atmospheric pressure, forming the so-called negative pressure. This prevents ink from flowing out when the nozzle device is paused or stops running. Finally, the cover plate 11 covers the box 10 to protect all the above-mentioned devices therein.

Figure 4:
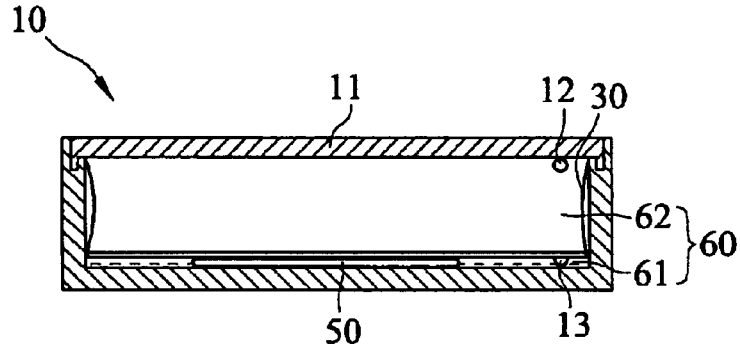
FIG. 4 is a schematic view of the actions in the first embodiment.

From the above description, we understand the relations of all devices in the box 10 and the basic design concept of the inventor. In the following, we explain the invention by referring to the state of the ink container in use. With reference to FIG. 4, the ink gradually decreases as it is used. The volume of the ink chamber 61 for storing the ink also shrinks. Ambient air enters the air chamber 62 via the through hole 12, maintaining the balance inside the accommodation space 60 in the box 10. As a result of the volume shrinkage in the ink chamber 61, the passive plate 40 and the connected elastic device 50 are depressed. The elastic device 50 provides a restoring force to push the passive plate 40 back, limiting the shrinking extent of the ink chamber 61 to a particular range. Therefore, the ink chamber 61 has a negative pressure, which is maintained in a specific range such that the nozzle device 20 can operate normally. With the use of a conic spiral spring, the elastic device 50 can be shrunk close to the wire thickness of the elastic device 50. Therefore, in comparison with the usual spring, the first embodiment of the invention can fully utilize the ink stored inside the ink chamber 61.

Figure 5:
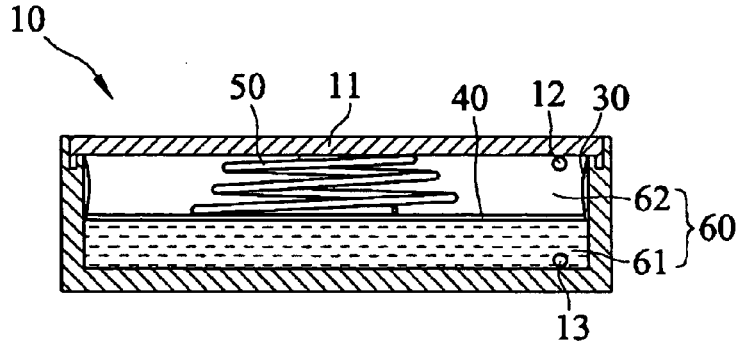
FIG. 5 is a schematic view the second embodiment of the invention.

The installation positions of the elastic device 50 and the passive plate 40 are not limited to the side of the ink chamber 61. They can be in the air chamber too 62. FIG. 5 shows the second embodiment of the invention. According to the invention, the pressure stabilizer module is installed inside the box 10. The airtight membrane 30 separates the accommodation space 60 into an ink chamber 61 and an air chamber 62. A passive plate 40 is attached to one side of the airtight membrane 30. Different from the previous embodiment, the passive plate 40 is installed inside the air chamber 62. One end of the elastic device 50 is connected to the passive plate 40. The elastic device 50 is installed in such a way that it is normally stretched inside the air chamber 62. When the volume of the ink chamber 61 gets smaller in use, the elastic device 50 provides a restoring force to drag the passive plate 40 and the connected airtight membrane 30. This limits the shrinking extent of the ink chamber 61. Therefore, the negative pressure is maintained within a specific range. Of course, the elastic device 50 is not restricted to springs. It can be anything that can provide depressing or stretching force.

Figure 6:
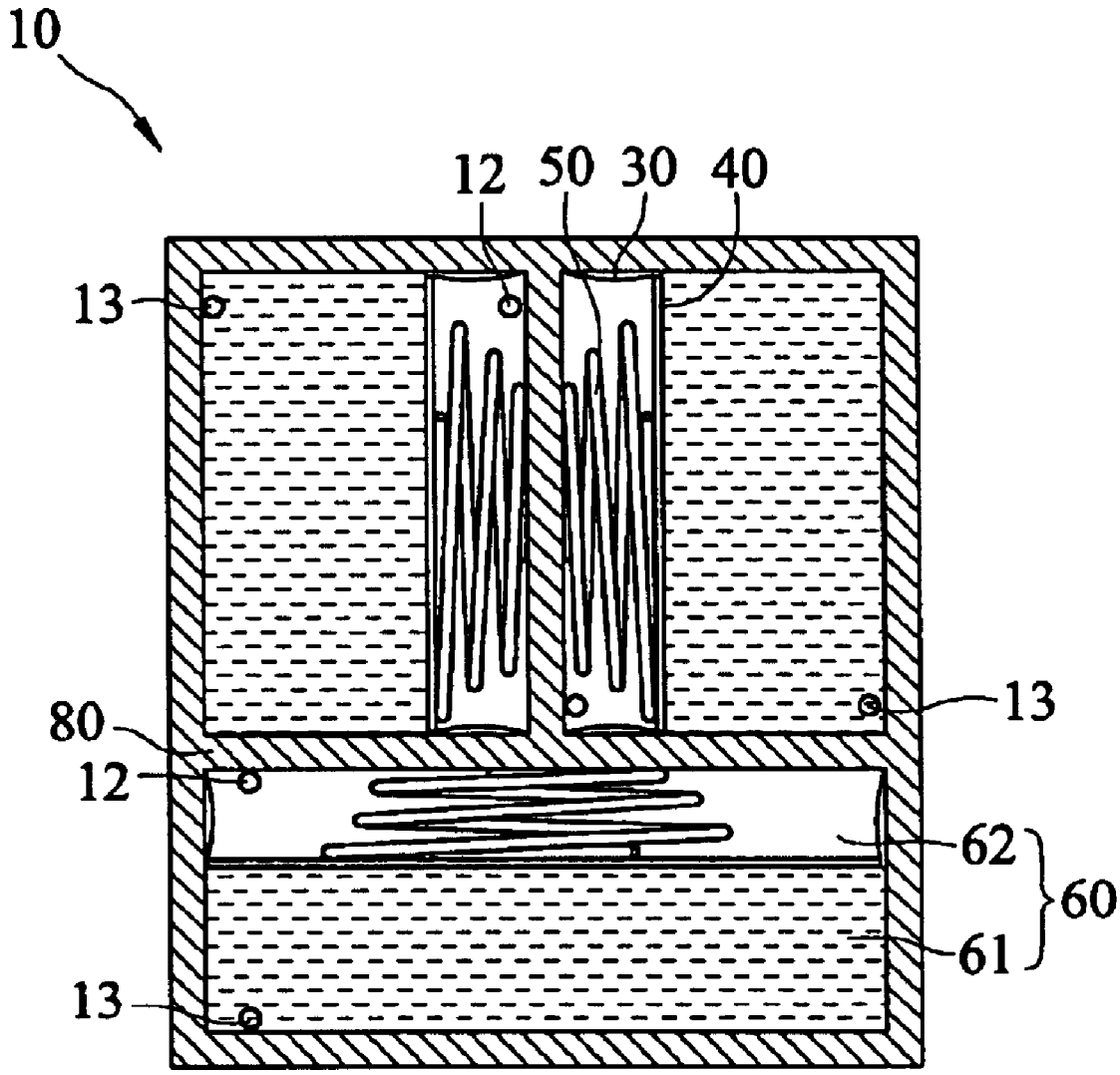
FIG. 6 is a schematic view the fourth embodiment of the invention.

Moreover, one can install multiple sets of pressure stabilizer modules such as the airtight membrane in the box 10. In this fourth embodiment, separator plates should be used to divide the box 10 into several regions. With reference to FIG. 6, the separator plate 80 divides the inside of the solid box 10 into several accommodation spaces 60. Each accommodation space 60 is divided by an airtight membrane 30 into an ink chamber and an adjacent air chamber 62. As in the previously mentioned embodiments, a passive plate 40 and an elastic device 50 are installed in either the ink chamber 61 or air chamber 62 for each accommodation space.

Figure 7B:
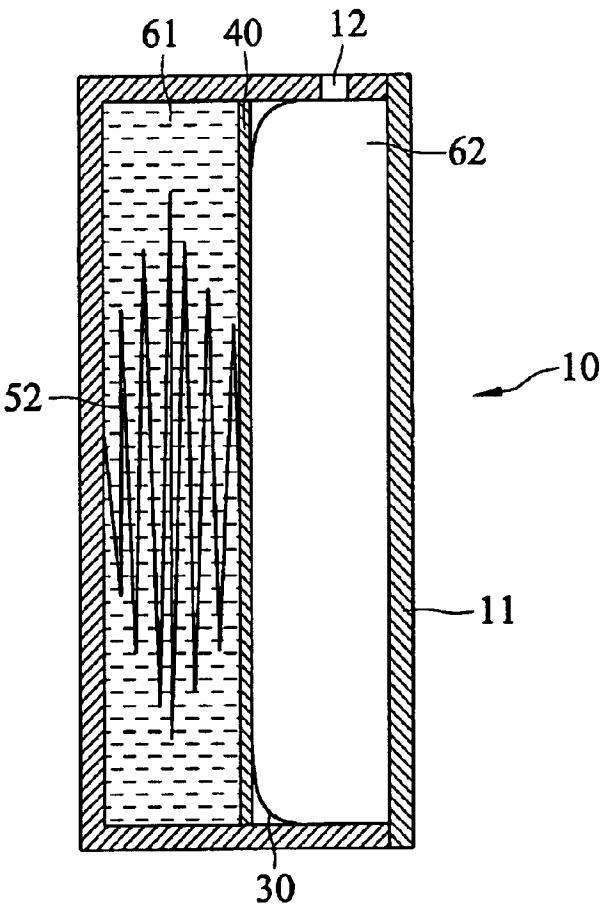
FIGS. 7A and 7B are schematic views of the fifth and sixth embodiments of the invention.
Figure 7A:
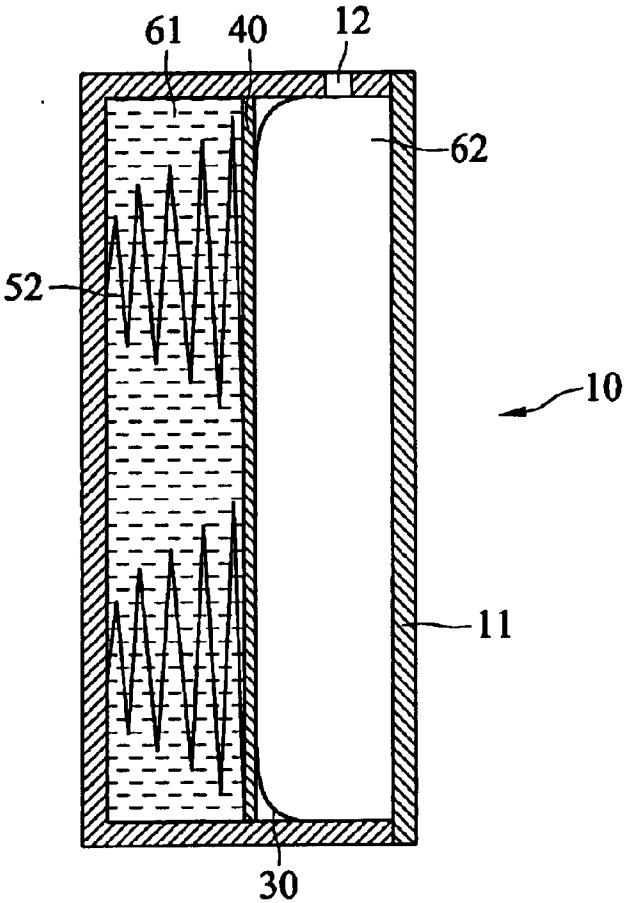

Another two preferred embodiments are shown in FIGS. 7A and 7B. Several conic spiral springs 52 are installed in these embodiments. The wire thickness and number of coils of the conic spiral spring 52 are determined according to the predetermined negative pressure in the ink chamber 61. They are installed in parallel or in series inside the accommodation space 60 of the box 10. Likewise, their function is to maintain the negative pressure of the ink chamber 61 within a predetermined range.

Figure 8B:
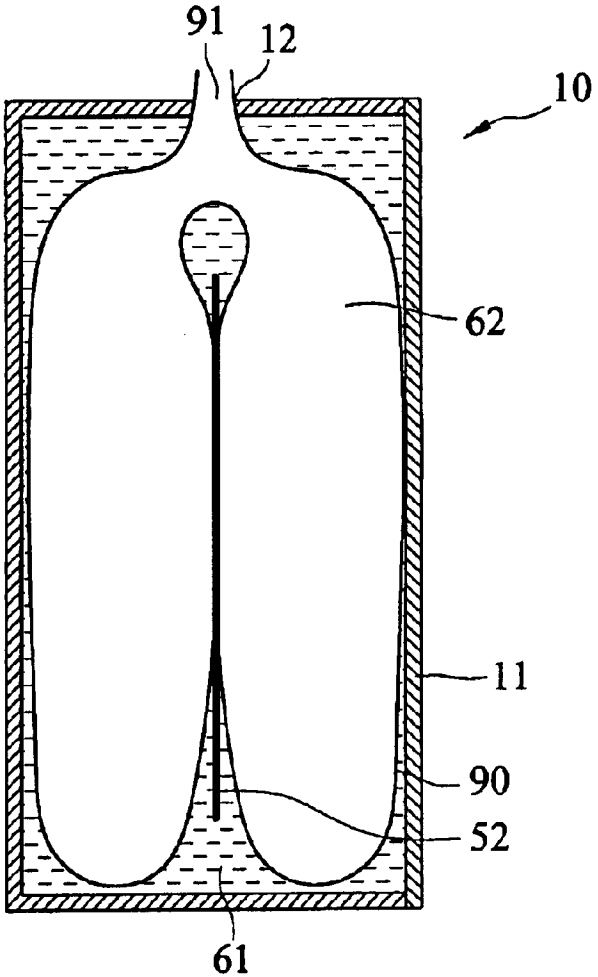
FIGS. 8A and 8B are schematic views of the seventh embodiment of the invention.
Figure 8A:
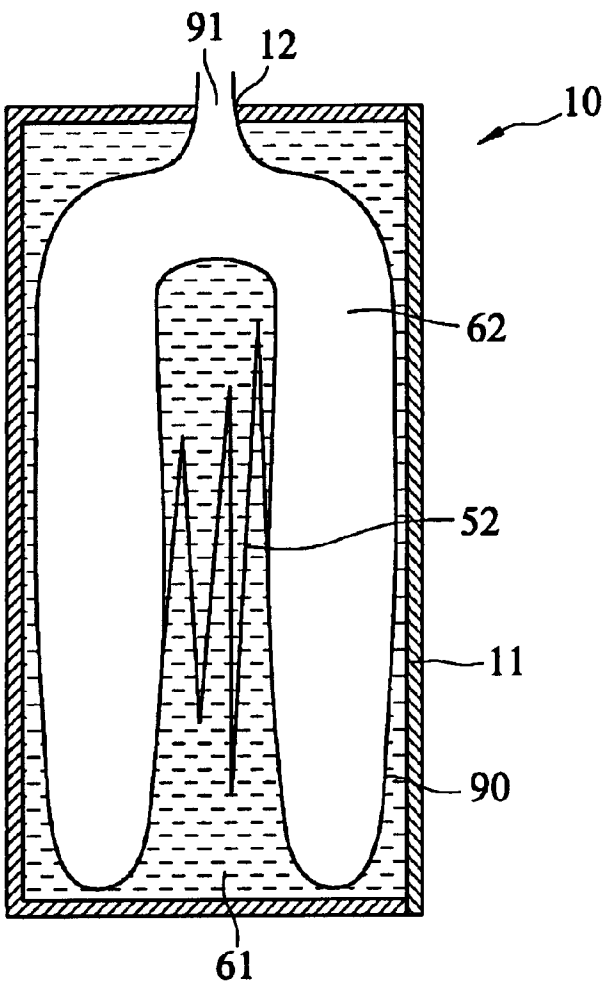

Of course, the conic spiral spring 52 can be used in an ink cartridge with an airbag membrane. FIGS. 8A and 8B show the seventh embodiment of the invention. The airbag membrane 90 has an inlet 91 corresponding to the through hole 12 on the box 10 for ambient air to enter the air chamber 62. The airbag membrane 90 encloses the air chamber 62. The conic spiral spring 52 is installed in the ink chamber 61. As the size of the ink chamber 61 gets smaller in use, the ambient air enters via the inlet 91 so that the ink chamber 61 is maintained at a predetermined negative pressure (FIG. 8B). One side of the box 10 is installed with a cover plate 11 to prevent ink stored inside the ink chamber 61 from leaking out.

Figure 9B:
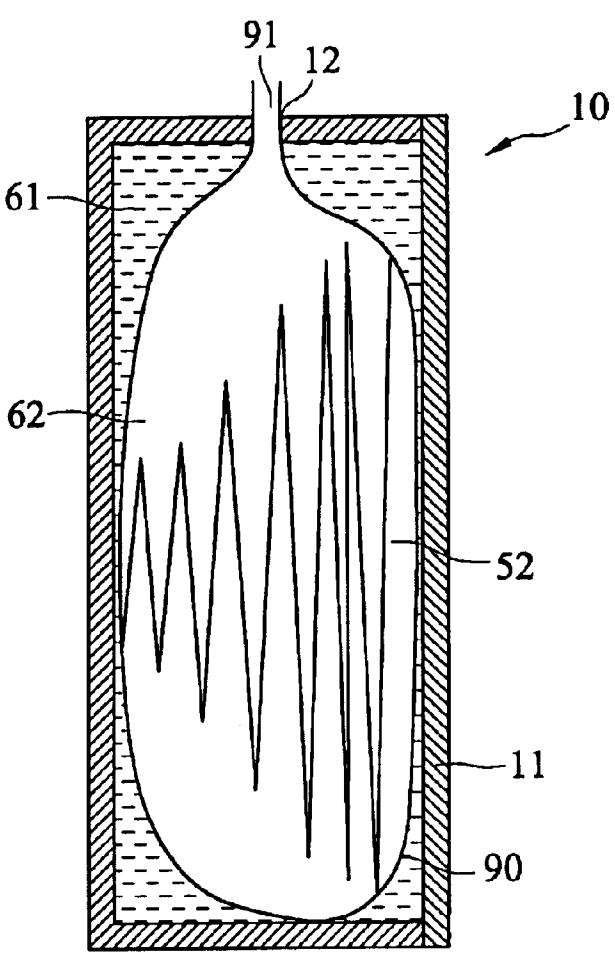
FIGS. 9A and 9B are schematic views of the eighth embodiment of the invention.
Figure 9A:
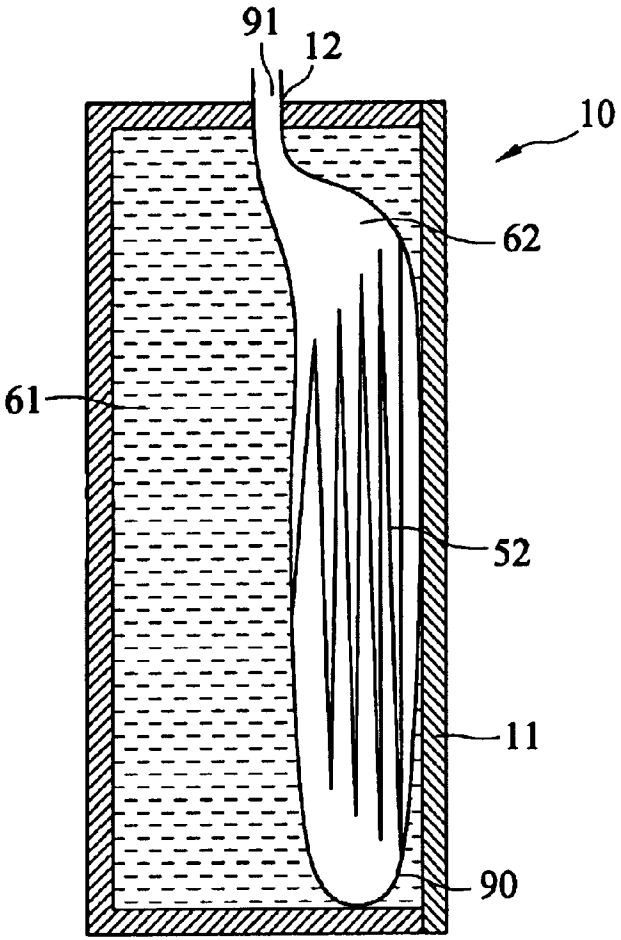

The conic spiral spring 52 can be installed inside the airbag membrane 90. Please refer to FIGS. 9A and 9B for the eighth embodiment of the invention. The conic spiral spring 52 is installed inside the airbag membrane 90 in such a way that it is normally depressed, thereby maintaining the ink chamber 61 at a predetermined negative pressure. Again, ambient air enters the air chamber 62 inside the airbag membrane 90 via the inlet 91. As the size of the ink chamber 61 gets smaller in use, the conic spiral spring 52 provides a restoring force to inflate the airbag membrane 90. The negative pressure is thus kept within an operating range.

Figure 10:
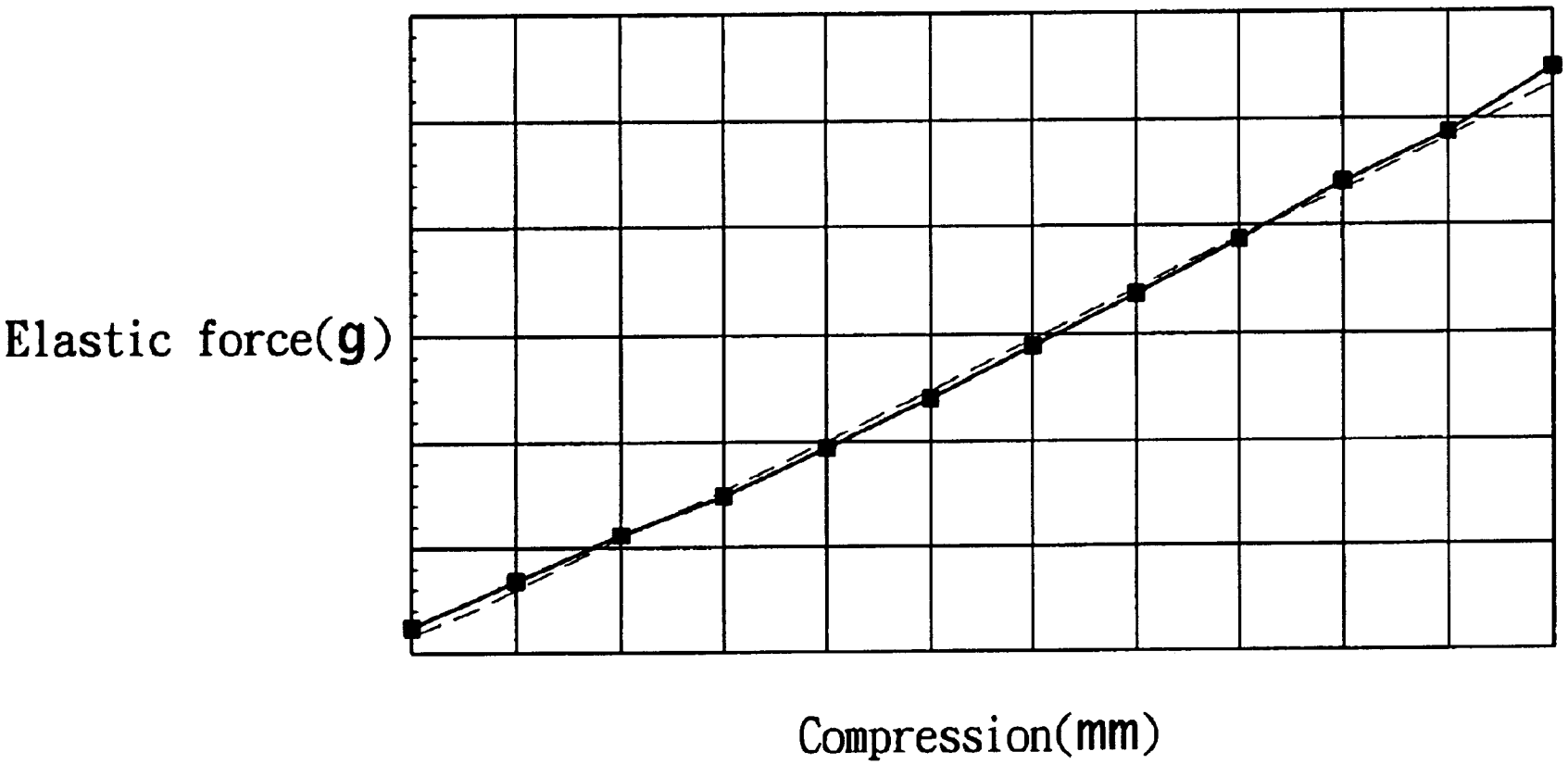
FIG. 10 shows the relation between the compression and the elastic force of the conic spiral spring.
Figure 11:
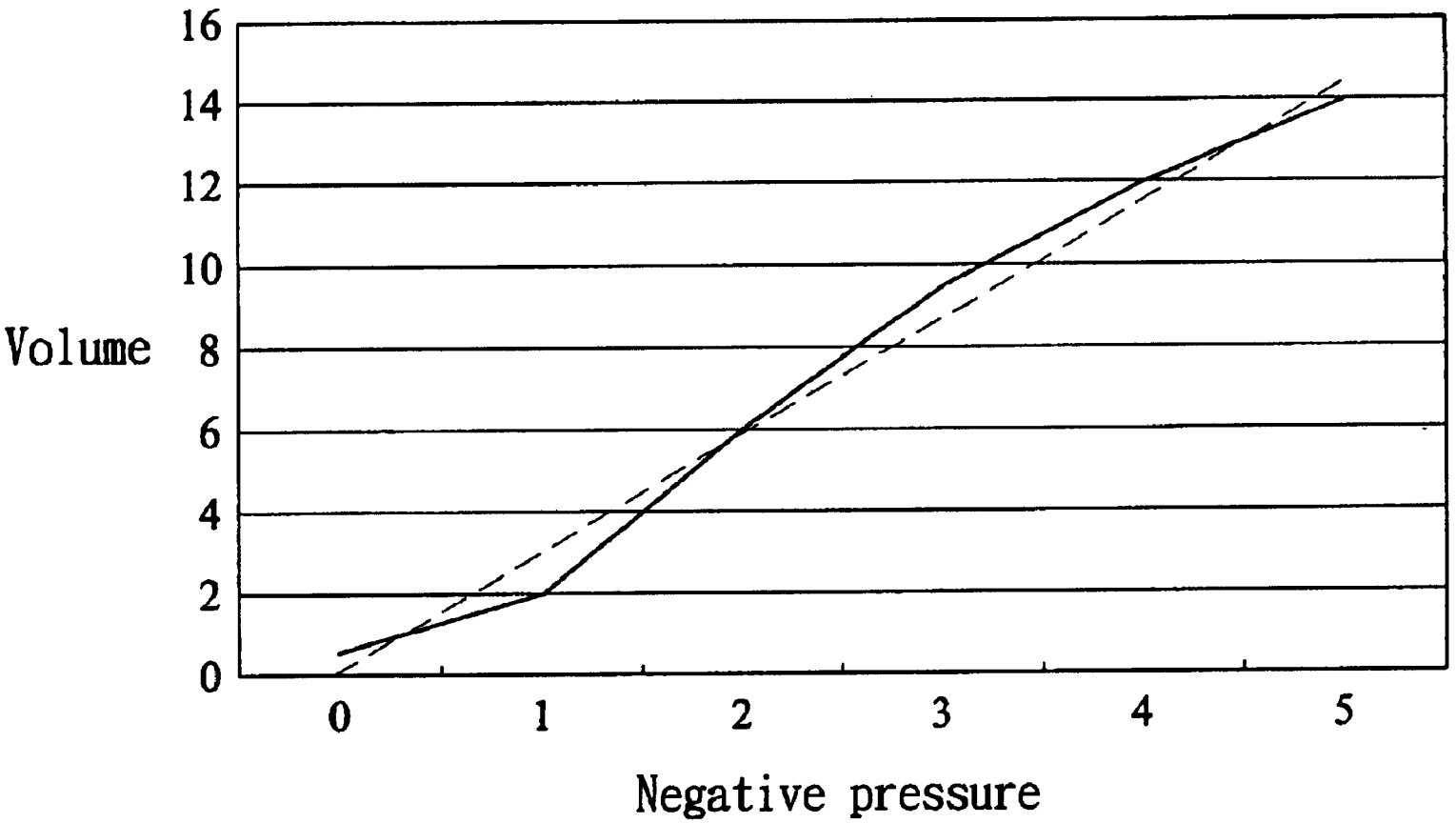
FIG. 11 shows the relation between the negative pressure and volume change of the ink chamber.

Using the conic spiral spring 52, we obtain the relation between the elastic force and the compression as in FIG. 10. This curve shows that the compression and the elastic force have an almost linear relation, just like a usual spring. Using the combination of a conic spiral spring 52 and an ink space 10 in an experiment, we obtain the relation between the negative pressure inside the ink space and the volume change as shown in FIG. 11. We also see that the negative pressure and the volume change have an approximately linear relation. Thus, when the ink volume inside the ink chamber 61 changes, the negative pressure inside the ink chamber 61 can still be maintained.

The conventional ink containers need an independent box and an additional negative pressure control mechanism. They thus have a higher cost. According to the disclosed design, only a few devices and a simple manufacturing process are required. Consequently, the invention can greatly reduce the cost, while enhancing the product performance.

Certain variations would be apparent to those skilled in the art, which variations are considered within the spirit and scope of the claimed invention.

What is claimed is:

1. An ink container having a pressure stabilizer module for applications in inkjet printers, which comprises:

a box having an accommodation space with one end having a plurality of nozzle devices to eject ink; and at least one pressure stabilizer modules installed inside the box for controlling the pressure of the ink, each of the pressure stabilizer modules containing:

an airtight membrane installed inside the box to form an ink chamber for storing the ink;

a passive plate connected to the air-tight membrane and installed on the inner side of the ink chamber;

a conic spiral spring having one end connected to one side of the passive plate and is installed in such a way that it is normally depressed on the inner side of the ink chamber to provide a negative pressure;

wherein as the size of the ink chamber gets smaller in use, the conic spiral spring provides a depressing force to push against the passive plate, the conic spiral spring is depressible down to the thickness of the spring wire to reduce wastage of ink, and the conic spiral spring helps maintaining the negative pressure; and a plurality of conical springs installed in parallel or in series in the box, wherein the spring wire diameter and number of coils of the conic spiral spring are determined according to the predetermined negative pressure of the ink chamber.

2. The ink container having a pressure stabilizer module of claim 1, further comprising a cover plate covering one side of the box and forming an air chamber with the air-tight membrane.

3. The ink container having a pressure stabilizer module of claim 1, wherein the ink chamber has an ink channel connected to the nozzle device for ejecting the ink stored in the ink chamber.

4. The ink container having a pressure stabilizer module of claim 1, wherein the airtight membrane is made of an elastic and deformable material.

5. The ink container having a pressure stabilizer module of claim 1, wherein the spring wire thickness and number of coils of the conic spiral spring are determined according to the predetermined negative pressure of the ink chamber.

6. An ink container having a pressure stabilizer module for applications in inkjet printers, which comprises:

a box having an accommodation space with one end having a plurality of nozzle devices to eject ink; and at least one pressure stabilizer modules installed inside the box for controlling the pressure of the ink, each of the pressure stabilizer modules containing:

an airbag membrane enclosing an air chamber and is installed inside the box to form an ink chamber for storing the ink; and a conic spiral spring selectively installed inside or outside the airbag membrane;

wherein as the size of the ink chamber gets smaller in use, the conic spiral spring provides a depressing/restoring force on the airbag membrane, the conic spiral spring is depressible down to the thickness of the spring wire, and limiting the shrinking extent of the ink chamber and maintaining the negative pressure; and wherein the spring wire thickness and the number of coils of the conic spiral spring is determined according to the predetermined negative pressure of the ink chamber.

7. The ink container having a pressure stabilizer module of claim 6, further comprising a cover plate covering one side of the box to prevent the ink stored in the ink chamber from permeating out.

8. The ink container having a pressure stabilizer module of claim 6, wherein the airbag membrane is made of an elastic and deformable material.

9. The ink container having a pressure stabilizer module of claim 6, wherein the box has a through hole in fluid communications with the exterior.

10. The ink container having a pressure stabilizer module of claim 9, wherein the airbag membrane further contains an inlet connected to the through hole of the box for ambient air to replenish the airbag membrane.

* * * * *